US011629555B2

(12) United States Patent
D'Silva

(10) Patent No.: US 11,629,555 B2
(45) Date of Patent: Apr. 18, 2023

(54) DRILLING A BOREHOLE WITH A STEERING SYSTEM USING A MODULAR CAM ARRANGEMENT

(71) Applicant: Halliburton Energy Services, Inc., Houston, TX (US)

(72) Inventor: Alben D'Silva, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 144 days.

(21) Appl. No.: 17/278,976

(22) PCT Filed: Dec. 21, 2018

(86) PCT No.: PCT/US2018/067073

§ 371 (c)(1),
(2) Date: Mar. 23, 2021

(87) PCT Pub. No.: WO2020/131098

PCT Pub. Date: Jun. 25, 2020

(65) Prior Publication Data

US 2022/0034166 A1 Feb. 3, 2022

(51) Int. Cl.
*E21B 7/06* (2006.01)

(52) U.S. Cl.
CPC ..... *E21B 7/06* (2013.01)

(58) Field of Classification Search
CPC . E21B 7/06; E21B 7/061; E21B 7/062; E21B 7/067; E21B 7/068
See application file for complete search history.

(56) References Cited

U.S. PATENT DOCUMENTS 3,667,556 A * 6/1972 Henderson ..... E21B 7/068 175/73
4,880,066 A * 11/1989 Steiginga ..... E21B 31/03 175/325.2
5,113,953 A * 5/1992 Noble ..... E21B 4/20 175/73
5,467,834 A 11/1995 Hughes et al.
6,092,610 A * 7/2000 Kosmala ..... E21B 4/20 175/73
6,328,119 B1 12/2001 Gillis et al.
7,481,281 B2 * 1/2009 Schuaf ..... E21B 3/02 476/40
7,654,340 B2 * 2/2010 Self ..... E21B 7/28 175/62
9,556,678 B2 * 1/2017 Schaaf ..... E21B 7/067
2002/0175003 A1 * 11/2002 Pisoni ..... E21B 7/067 175/74

(Continued)

FOREIGN PATENT DOCUMENTS

WO 2015076850 A1 5/2015

OTHER PUBLICATIONS

International Search Report and Written Opinion dated Aug. 27, 2019 for PCT No. PCT/US2018/067073 filed Dec. 21, 2018 (14 pgs).

*Primary Examiner* — Benjamin F Fiorello
(74) *Attorney, Agent, or Firm* — K&L Gates LLP

(57) ABSTRACT

A cam system for use with a rotary steerable system, the cam system includes a housing, a cam positioned at least partially within the housing, and a solid cam shaft engaged with the cam and positioned at least partially within the housing, wherein the cam is operable to adjust an azimuthal orientation of the solid cam shaft.

13 Claims, 4 Drawing Sheets

(56) References Cited

U.S. PATENT DOCUMENTS

| | | | | |
|---|---|---|---|---|
| 2006/0243487 | A1* | 11/2006 | Turner | E21B 7/068 175/26 |
| 2009/0166089 | A1 | 7/2009 | Millet | |
| 2017/0247947 | A1* | 8/2017 | Savage | E21B 4/02 |
| 2017/0306740 | A1* | 10/2017 | Song | G05B 13/041 |
| 2018/0010390 | A1* | 1/2018 | Van Og | E21B 7/068 |
| 2018/0080283 | A1* | 3/2018 | Wang | E21B 7/064 |
| 2018/0252042 | A1* | 9/2018 | Nanayakkara | E21B 41/0085 |
| 2020/0362637 | A1* | 11/2020 | Peters | E21B 3/00 |

* cited by examiner

DRILLING A BOREHOLE WITH A STEERING SYSTEM USING A MODULAR CAM ARRANGEMENT

BACKGROUND

Drill strings are utilized to create boreholes in formations to extract fluids from the formations. In certain drilling operations, the drill string is angled to create a deviated or horizontal borehole. A rotary steerable system (RSS) is utilized in such drill strings to direct the drill string at an angle. In a point-the-bit RSS, the RSS includes a cam module that deflects a cam shaft at an angle and rotates the cam shaft while maintaining the angle. The deflected cam shaft directs the drill bit at an angle. In some point-the-bit systems, the cam module affixes the cam shaft at a certain angle. The cam shaft is hollow to allow drilling fluid to pass through the cam shaft as the drilling fluid flows to the drill bit.

BRIEF DESCRIPTION OF THE DRAWINGS

Embodiments of the system and method for a drilling a borehole with a steering system using a modular cam arrangement are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
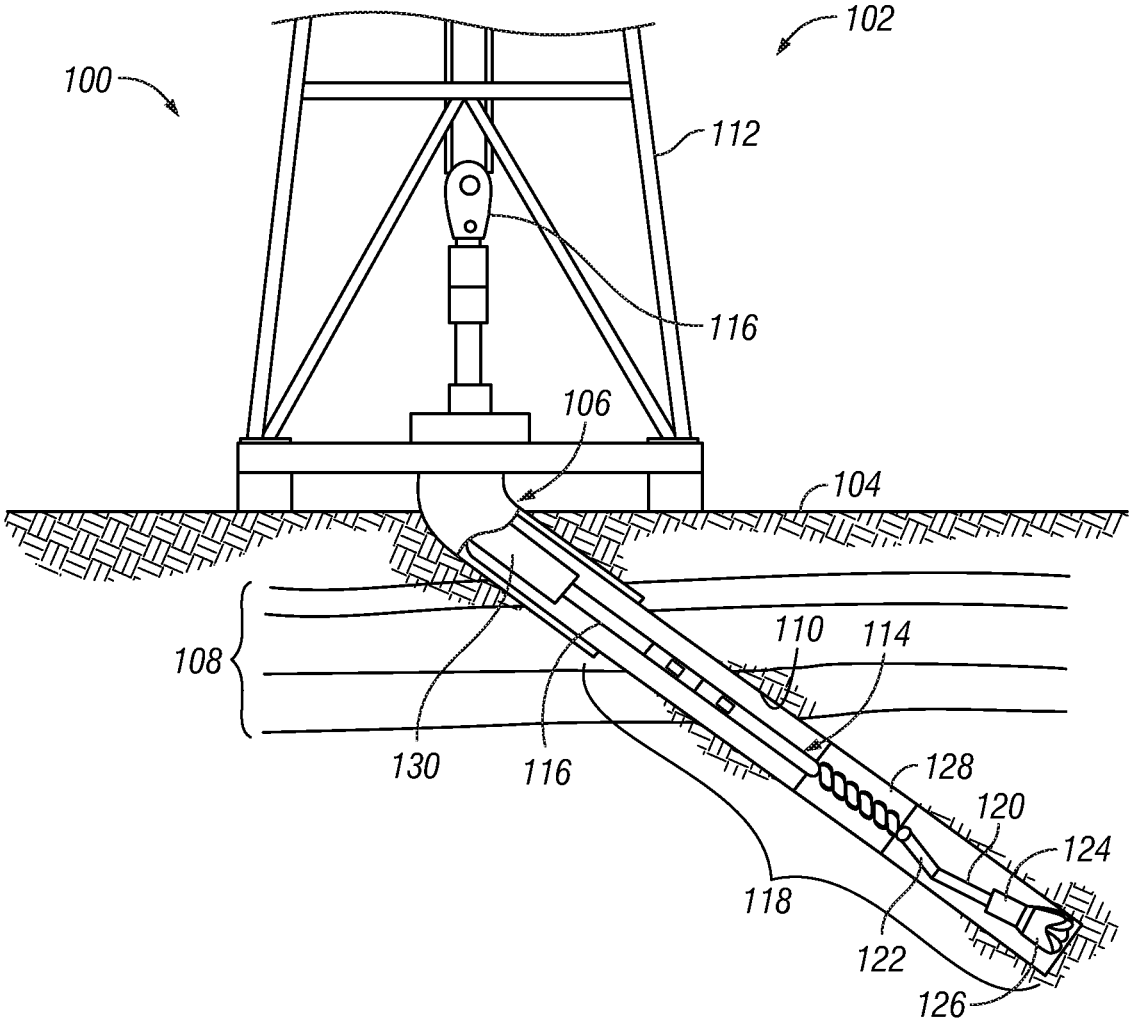
FIG. 1 illustrates a schematic view of a well system with a drill string.

FIG. 1 illustrates a well system 100 that includes a rig 102 located at a surface 104 of a wellbore 106 extending into a formation 108. The wellbore 106 is an opening in the formation 108 used to extract fluids or store fluids, such as hydrocarbons or water. Further, while the wellbore 106 is shown as extending at an angle into the formation 108, the well 106, or portions of the wellbore 106, may extend at any angle between vertical and horizontal.

The rig 102 is utilized in operations that include the use of the wellbore 106. The rig 102 includes a derrick 112 to physically support the structure of the rig 102, including a drill string 114 and an elevator 116 that can raise and lower the drill string 114. Further, the well system 100 is shown as a surface well but may also be used for an offshore well.

The drill string 114 operates to penetrate through the formation 108. The drill string 114 includes a drill pipe 116 and a bottom hole assembly (BHA) 118, located at the lower portion of the drill pipe 116. The BHA 118 includes a rotary steerable system (RSS) 120 that incorporates a tilted or offset shaft 122 coupled to a constant velocity (CV) section 124 and a drill bit 126. The drill bit 126 rotates to create the wellbore 106 by penetrating the formation 108.

During drilling operations, the drill bit 126 is rotated by the mud motor 128 by flowing a drilling fluid through the mud motor 128. In one or more embodiments, the rotation may be provided by a top drive system at the surface 104 or a turbine motor. The drilling fluid then passes through the RSS 120, the CV section 124, and out of the drill bit 126. Drill collars 130 may be used to add weight to the drill bit 126. The drill collars 130 may also operate to stiffen the BHA 118, allowing the BHA 118 to transfer the added weight to the drill bit 126, and in turn, to assist the drill bit 126 in penetrating the formation 108.

Figure 2A:
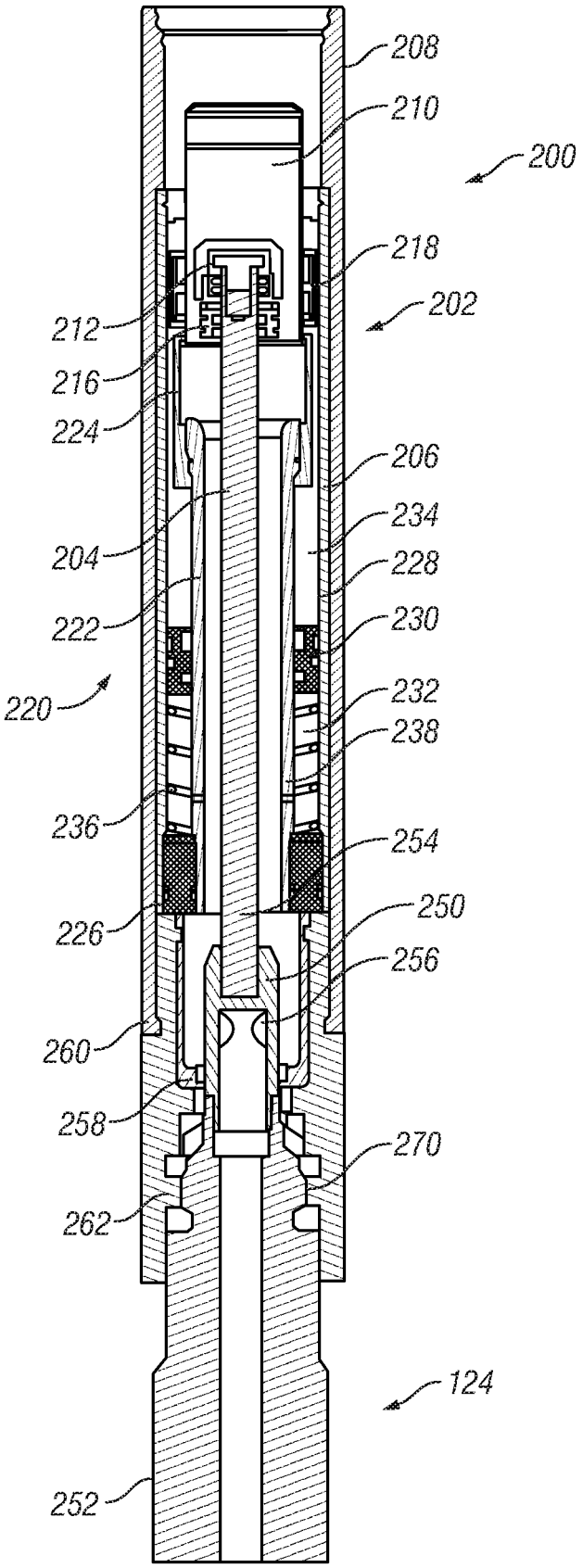
FIG. 2A illustrates a cross-sectional view of an embodiment of a steering head of a drill string.
Figure 2B:
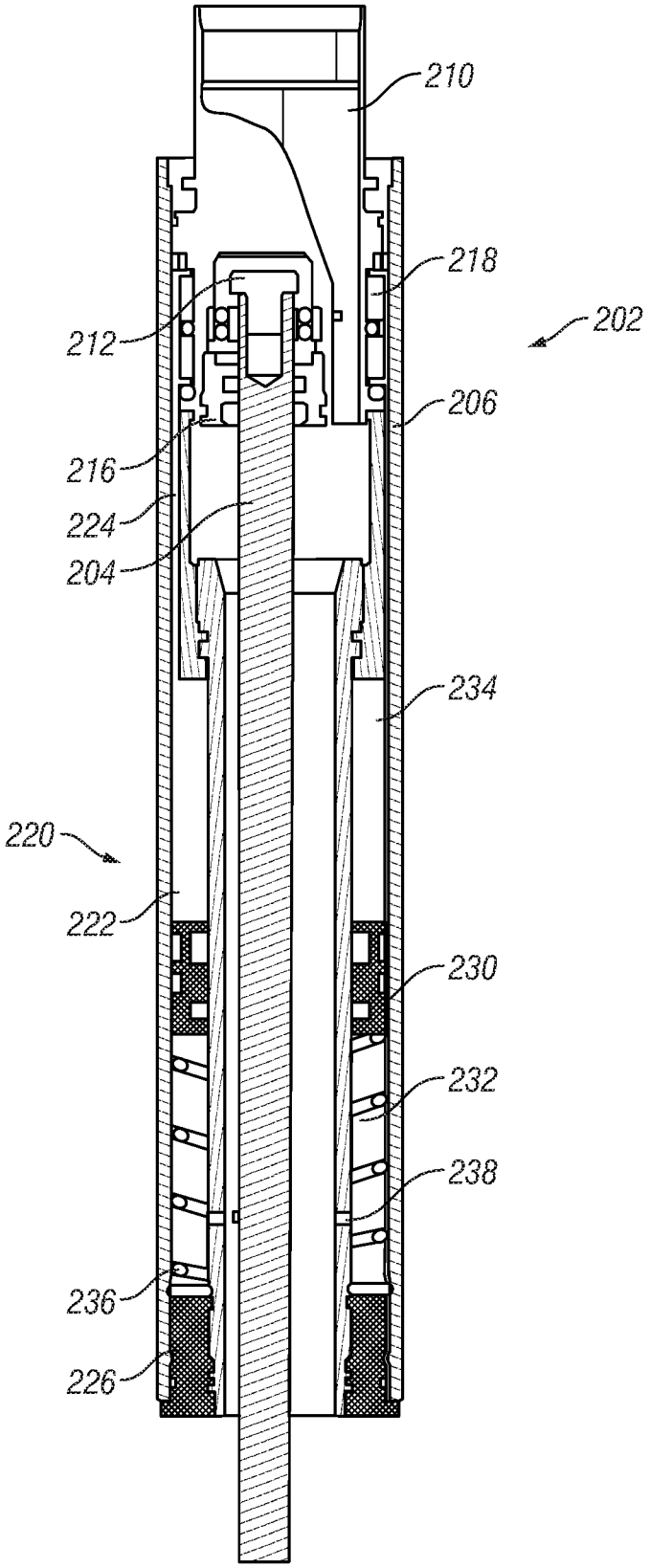
FIG. 2B illustrates a cross-sectional view of an embodiment of a cam module used within the steering head of FIG. 2A.

FIG. 2A is a cross-sectional view of a steering head 200 used within the RSS 120 of FIG. 1 above the CV section 124. The steering head 200 includes a cam module 202 positioned within a steering collar 208. FIG. 2B illustrates a cross-sectional view of the cam module 202, which includes a cam shaft 204 at a fixed offset angle that enables the drill bit 126 to penetrate the formation 108 at the offset angle. The mud motor 128 rotates the steering collar 208 and the CV section 124, which, in turn, provides the rotation to the drill bit 126. The cam shaft 204 is positioned at the offset angle and coupled to the CV section 124 such that the CV section 124 is also at the offset angle. The rotation of the CV section 124 also rotates the cam shaft 204.

Figure 2C:
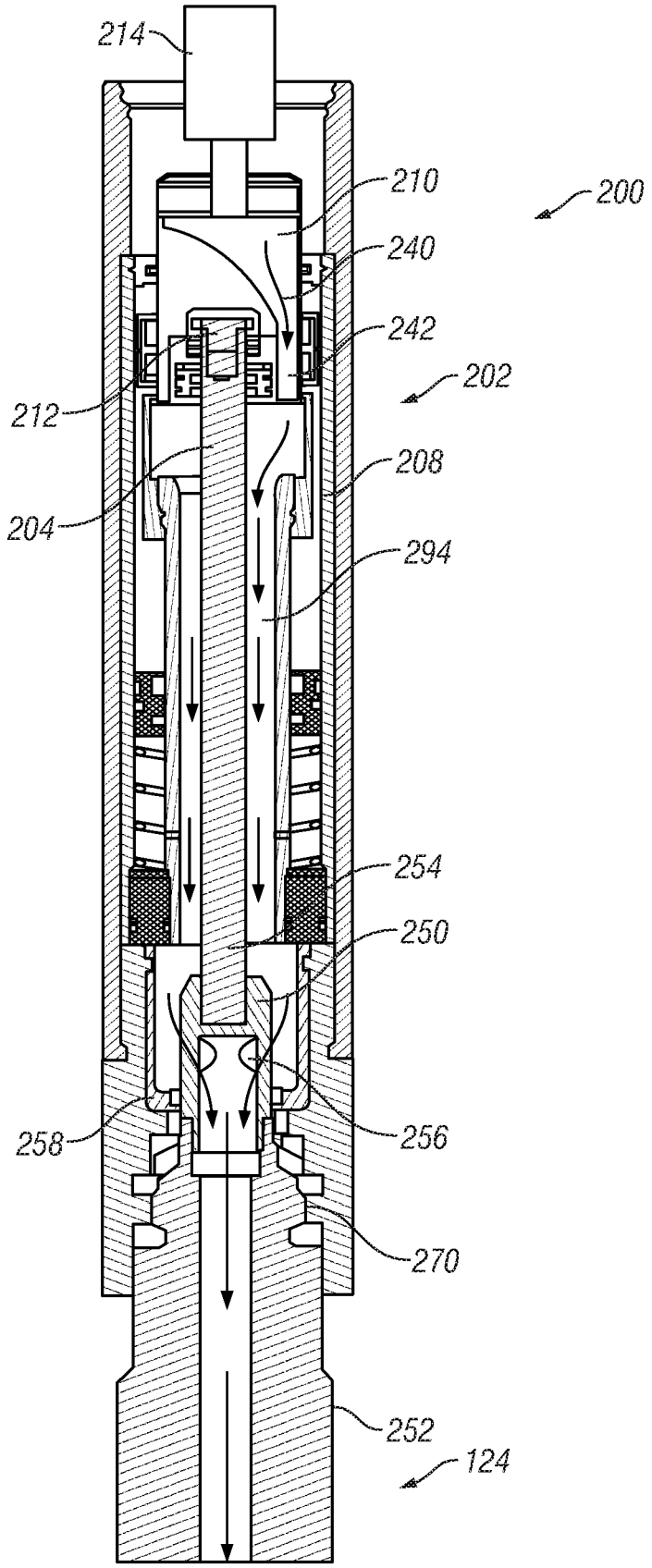
FIG. 2C illustrates a cross-sectional view of a flow path for drilling fluid flowing through the steering head of FIG. 2A.

As the cam shaft 204 rotates, the cam shaft 204 rotates about its own central axis and rotates in nutation about the central axis of the cam module 202. A cam 210 is coupled to an uphole end 212 of the cam shaft 204, and the cam 210 is rotatable to adjust and/or maintain an azimuthal orientation (i.e., the direction of the offset angle) of the cam shaft 204 while the cam shaft 204 rotates. Thus, a motor 214, as illustrated in FIG. 2C, rotates the cam 210 in a direction opposite to the rotation of the cam shaft 204 due to the mud motor 128 to maintain the azimuthal orientation of the cam shaft 204 and prevent the cam shaft 204 from rotating about the central axis of the cam module 202. For example, if the cam shaft 204 is rotating at 100 revolutions per minute (RPM) in one direction, then the cam 210 rotates at 100 RPM in the opposite direction to maintain the azimuthal orientation of the cam shaft 204. Further, to change the azimuthal orientation of the cam shaft 204, the cam 210 is rotated at a different RPM than the cam shaft 204.

The cam module 202 includes a compensation sleeve 206 that serves as a housing for the cam module 202. The cam shaft 204 is positioned partially within the compensation sleeve 206. The cam shaft 204 is a solid shaft so instead of drilling fluid flowing through the cam shaft 204, drilling fluid flows around the cam shaft 204.

Further, the cam 210 includes a seal carrier 216 that carries multiple seals radially between the cam 210 and the cam shaft 204. The seal carrier 216 prevents fluid from flowing into the cam 210 at the intersection of the cam 210 and the cam shaft 204. Further, the seal carrier 216 carries at least one bearing to reduce friction during relative rotation between the cam shaft 204 and the cam 210.

One or more bearings 218 are positioned radially between the cam 210 and the compensation sleeve 206 to reduce wear between the compensation sleeve 206 and the cam 210. The bearings 218 utilize a lubricating fluid such as oil to reduce the friction between the cam 210 and the bearings 218. A lubrication system 220 is included within the cam module 202 to provide oil to the bearings 218.

The shaft cap 250 couples to a downhole end 254 of the cam shaft 204 and to the hollow CV shaft 252. The shaft cap 250 includes one or more flow channels 256 to allow fluid to flow from the area 244 to a bore of the shaft cap 250 and into the hollow CV shaft 252. The steering head 200 also includes a flow diverter 258 positioned around the shaft cap 250 and shaped with a radially inward curve to direct the drilling fluid into the flow channels 256. Using the shaft cap 250, the cam module 202 with the solid cam shaft 204 may couple to existing systems that employ the hollow CV shaft 252.

As described above, the cam shaft 204 rotates about an axis offset from a central axis, and the hollow CV shaft 252 rotates about a central axis of the CV section 124, which is aligned with the offset axis of the cam shaft 204. The shaft cap 250 is utilized to pivot the offset rotation of the cam shaft 204 to rotation about the central axis thereby enabling rotation to transfer from the cam shaft 204 to the hollow CV shaft 252. A rounded portion 270 of the CV shaft 252 serves as the pivot point between the CV shaft 252 and the steering collar 208.

As shown in FIG. 2A and more closely in FIG. 2B, the compensation sleeve 206, a flow sleeve 222, a seal sleeve 224, and an end cap 226 define an inner cavity 228 of the lubrication system 220. Further, a piston 230 is positioned within the inner cavity 228 to separate the inner cavity 228 into a first chamber 232 and a second chamber 234. A biasing device 236, such as a spring, is positioned within the first chamber 232 and between the end cap 226 and the piston 230 to bias the piston 230 into the second chamber 234. The second chamber 234 is filled with the incompressible lubricating fluid and is fluidly coupled to the bearings 218. The first chamber 232 includes one or more ports 238 to allow drilling fluid to flow into the first chamber 232. Thus, the pressure of the drilling fluid inside the cam module 202 acts on the piston 230 to equalize pressure between the first chamber 232 and the second chamber 234. The equalized pressure prevents the lubricating fluid from leaking out of the second chamber 234 and prevents drilling fluid from leaking into the second chamber 234. To further prevent leakage into or out of the second chamber 234, seals are positioned along the piston 230 and between the flow sleeve 222 and the seal sleeve 224. The ports 238 equalize pressure between the second chamber 234 and an area 244 rather than the second chamber 234 and an area outside the compensation sleeve 206, which reduces the pressure differential across the seals.

FIG. 2C illustrates a cross-sectional view of the steering head 200 along with a flow path of drilling fluid. As shown, during drilling, the drilling fluid flows along a flow path shown by arrows 240 through the steering head 220 and into the CV section 124. The drilling fluid flows into the steering head 200 through a channel 242 between the cam 210 and the compensation sleeve 206, then through an area 244 around the cam shaft 204, then into a shaft cap 250, and into a hollow CV shaft 252.

The cam module 202 is separable from the rest of the steering head 200. When the cam module 202 is deployed downhole, the offset angle of the cam shaft 204 is locked, but the azimuthal orientation of the cam shaft 204 may be adjusted by the cam 210, as described above, in a fixed bend design. However, different cam modules 202 may include cam shafts 204 with different offset angles for different build rate capability, also known as dogleg severity. With the cam module 202 being separable from the rest of the steering head 200, the cam module 202 can be replaced for a different cam module having a cam shaft at a different offset angle without the need to replace the CV section 124.

For example, in replacing the cam module 202 for a different cam module, the CV section 124 is disconnected from the steering head 200 and the hollow CV shaft 252 is disconnected from the shaft cap 250. Then, the shaft cap 250 is disconnected from the cam shaft 204. Then, a second section 262 of the steering collar 208 is removed from a first section 260 of the steering collar 208. Next, the cam module 202 may be removed from the first section 260.

With the cam module 202 removed, a different cam module may be inserted into the first section 260. Then, the shaft cap 250 is connected to the different cam module and the second section 262 is coupled to the first section 260. Next, the CV section 124 and the hollow CV shaft 252 are reconnected.

In some embodiments, two or more of the above steps may be performed at the same time. For example, the shaft cap 250, the second section 262, the CV section 124, and the hollow CV shaft 252 may remain coupled together as they are removed from the cam shaft 204 and the first section 260 and re-attached to the different cam shaft and first section 262. Further, as shown in FIG. 2B, the cam shaft 204 extends out of the compensation sleeve 206, which enables the cam shaft 204 to couple to the shaft cap 250 outside of the compensation sleeve 206, which improves access to the connection between the cam shaft 204 and the shaft cap 250.

When compared to hollow cam shafts of the same stiffness, the solid cam shaft 204 is able to have a smaller outer diameter, with all else equal. Thus, when utilized in a similar sized cam module 202, the solid cam shaft 204 can achieve a higher cam angle than a comparable hollow cam shaft because, with a smaller diameter, the solid cam shaft 204 can deflect a greater amount. Further, use of a smaller diameter reduces the torque needed to hold the solid cam shaft 204 in place compared to a hollow cam shaft rotating at the same rpm, which enables the use of a smaller motor 214, or may reduce the stress on the motor 214. In addition, a solid cam shaft 204 enables the use of materials having a lower Young's modulus. For example, titanium or titanium alloys may be used in place of steel alloys.

Further, using titanium or titanium alloys in place of steel enables the solid cam shaft 204 to have a decreased length when compared to hollow shafts composed of a steel alloy. The length of the solid cam shaft 204 may be reduced by up to half when compared to hollow shafts composed of a steel alloy. Further, a shaft with a decreased length may achieve a greater cam angle than a longer shaft because a shorter shaft can deflect more than a longer shaft. Conversely, if the solid, titanium cam shaft 204 is the same length as a comparable, hollow, steel cam shaft, the lower stiffness of titanium reduces forces acting on the bearings 218, thereby resulting is lower drag torque acting on the cam shaft 204.

Further examples may include:

Example 1 is a cam system for use with a rotary steerable system. The cam system includes a housing, a cam positioned at least partially within the housing, and a solid cam shaft coupled to the cam and positioned at least partially within the housing, wherein the cam can adjust an azimuthal orientation of the solid cam shaft.

In Example 2, the subject matter of Example 1 can further include a shaft cap coupled to the solid cam shaft at an end opposite of the cam. The shaft cap includes a bore and channels to allow a drilling fluid to flow from between the solid cam shaft and the housing to the bore of the shaft cap.

In Example 3, the subject matter of Examples 1-2 can further include wherein the shaft cap is coupleable to a hollow constant velocity shaft and the shaft cap is pivotable to pivot rotation of the solid cam shaft at the azimuthal orientation to rotation about a central axis.

In Example 4, the subject matter of Examples 1-3 can further include wherein the end of the solid cam shaft extends axially further than the housing to attach to the shaft cap outside of the housing.

In Example 5, the subject matter of Examples 1-4 can further include wherein a drilling fluid is flowable between the solid cam shaft and the housing.

In Example 6, the subject matter of Examples 1-5 can further include a bearing positioned between the cam and the housing, and a lubrication system that includes a lubricating fluid provideable to the bearing. The lubrication system also includes a flow sleeve positioned between the solid cam shaft and the housing to define a cavity between the flow sleeve and the housing. Further, the lubrication system includes a piston that fluidly separates the cavity into a first chamber and a second chamber. Moreover, the lubrication system includes a biasing device positioned in the second chamber and between the piston and an end cap to bias the piston into the first chamber. In addition, the lubricating fluid is within the first chamber, and the second chamber is in fluid communication with the drilling fluid to enable the piston to equalize pressure between the lubricating fluid and the drilling fluid.

In Example 7, the subject matter of Examples 1-6 can further include a motor coupled to the cam to maintain the azimuthal orientation of the solid cam shaft while the solid cam shaft rotates.

In Example 8, the subject matter of Examples 1-7 can further include wherein the solid cam shaft is composed of titanium.

Example 9 is A rotary steerable system ("RSS") includes a steering head and a cam system that includes a housing, a cam positioned at least partially within the housing, and a solid cam shaft coupled to the cam and positioned at least partially within the housing, wherein the cam can adjust an azimuthal orientation of the solid cam shaft. The RSS further includes a shaft cap coupled to the solid cam shaft at an end opposite of the cam, and the shaft cap includes a bore and channels to allow a drilling fluid to flow from between the solid cam shaft and the housing to the bore of the shaft cap. In addition, the RSS includes a constant velocity shaft coupled to the shaft cap.

In Example 10, the subject matter of Example 9 can further include wherein the shaft cap is pivotable to transfer rotation of the solid cam shaft at the azimuthal orientation to rotation about a central axis.

In Example 11, the subject matter of Examples 9-10 can further include wherein the end of the solid cam shaft extends axially further than the housing to attach to the shaft cap outside of the housing.

In Example 12, the subject matter of Examples 9-11 can further include wherein a drilling fluid can flow between the solid cam shaft and the housing.

In Example 13, the subject matter of Examples 9-12 can further include a bearing positioned between the cam and the housing, and a lubrication system that includes a lubricating fluid provideable to the bearing. The lubrication system also includes a flow sleeve positioned between the solid cam shaft and the housing to define a cavity between the flow sleeve and the housing. Further, the lubrication system includes a piston that fluidly separates the cavity into a first chamber and a second chamber. Moreover, the lubrication system includes a biasing device positioned in the second chamber and between the piston and an end cap to bias the piston into the first chamber. In addition, the lubricating fluid is within the first chamber, and the second chamber is in fluid communication with the drilling fluid to enable the piston to equalize pressure between the lubricating fluid and the drilling fluid.

In Example 14, the subject matter of Examples 9-13 can further include a motor coupled to the cam to maintain the azimuthal orientation of the solid cam shaft while the solid cam shaft rotates.

In Example 15, the subject matter of Examples 9-14 can further include wherein the solid cam shaft is composed of titanium.

Example 16 is a method for drilling a wellbore into a formation that includes deploying a drill string comprising a rotary steerable system into the wellbore, adjusting an angular direction of a drill bit using a cam system comprising a solid cam shaft and a cam coupled to the solid cam shaft and rotatable to adjust an azimuthal direction of the solid cam shaft, and drilling the borehole with the drill bit in the azimuthal direction.

In Example 17, the subject matter of Example 16 can further include replacing the cam module with a different cam module having a solid cam shaft at a different azimuthal direction.

In Example 18, the subject matter of Examples 16-17 can further include flowing a drilling fluid between the solid cam shaft and the housing.

In Example 19, the subject matter of Examples 16-18 can further include flowing a drilling fluid into a shaft cap coupled to the solid cam shaft at an end opposite of the cam, wherein the drilling fluid flows into the shaft cap through a bore and channels, out of the shaft cap, and into a constant velocity shaft.

In Example 20, the subject matter of Examples 16-19 can further include maintaining the azimuthal direction of the solid cam shaft with a motor while the solid cam shaft rotates.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A cam system for use with a rotary steerable system for use with a drilling fluid, the cam system comprising:

a housing comprising a housing central axis;

a cam positioned at least partially within the housing;

a solid cam shaft engaged with the cam and positioned at a fixed offset at least partially within the housing such that the solid cam shaft is rotatable about a cam shaft central axis;

a hollow constant velocity ("CV") shaft comprising a CV central axis; and a shaft cap coupled to the solid cam shaft at an end opposite of the cam and also coupled to the CV shaft, wherein:

the shaft cap comprises a bore and a channel to allow the drilling fluid to flow from an area outside the shaft cap between the solid cam shaft and the housing into the bore of the shaft cap; and the shaft cap is pivotable to pivot rotation of the solid cam shaft at the azimuthal orientation to rotation about the CV central axis, wherein the cam is rotatable to rotate the solid cam shaft about the housing central axis to adjust or maintain an azimuthal orientation of the solid cam shaft.

2. The cam system of claim 1, wherein the end of the solid cam shaft extends axially further than the housing to attach to the shaft cap outside of the housing.

3. The cam system of claim 1, further comprising a bearing positioned between the cam and the housing and a lubrication system, the lubrication system comprising:

a flow sleeve positioned between the solid cam shaft and the housing to define a cavity between the flow sleeve and the housing;

a piston that fluidly separates the cavity into a first chamber and a second chamber; and a biasing device positioned in the second chamber and between the piston and an end cap to bias the piston into the first chamber;

wherein a lubricating fluid is within the first chamber and in communication with the bearing, and the second chamber is in fluid communication with a drilling fluid inside the cam system to enable the piston to equalize pressure between the lubricating fluid and the drilling fluid.

4. The cam system of claim 1, further comprising a motor coupled to the cam and operable to rotate the cam to maintain the azimuthal orientation of the solid cam shaft while the solid cam shaft rotates within the cam.

5. The cam system of claim 1, wherein the solid cam shaft comprises titanium.

6. A rotary steerable system ("RSS") for use with a drilling fluid, comprising:

a steering head;

a cam system comprising:

a housing comprising a housing central axis;

a cam positioned at least partially within the housing; and a solid cam shaft engaged with the cam and positioned at a fixed offset at least partially within the housing such that the solid cam shaft is rotatable about a cam shaft central axis, wherein the cam is rotatable to adjust or maintain an azimuthal orientation of the solid cam shaft; and wherein the drilling fluid is flowable in an area between the solid cam shaft and the housing;

a hollow constant velocity ("CV") shaft comprising a CV central axis;

a shaft cap coupled to the solid cam shaft at an end opposite of the cam and also coupled to the CV shaft, wherein:

the shaft cap comprises a bore and a channel to allow the drilling fluid to flow from an area outside the shaft cap between the solid cam shaft and the housing into the bore of the shaft cap; and the shaft cap is pivotable to pivot rotation of the solid cam shaft at the azimuthal orientation to rotation about the CV central axis; and a drill bit engaged with the CV shaft.

7. The RSS of claim 6, wherein the end of the solid cam shaft extends axially further than the housing to attach to the shaft cap outside of the housing.

8. The RSS of claim 6, further comprising a bearing positioned between the cam and the housing and a lubrication system, the lubrication system comprising:

a flow sleeve positioned between the solid cam shaft and the housing to define a cavity between the flow sleeve and the housing;

a piston that fluidly separates the cavity into a first chamber and a second chamber; and a biasing device positioned in the second chamber and between the piston and an end cap to bias the piston into the first chamber;

wherein a lubricating fluid is within the first chamber and in communication with the bearing, and the second chamber is in fluid communication with a drilling fluid inside the cam system to enable the piston to equalize pressure between the lubricating fluid and the drilling fluid.

9. The RSS of claim 6, further comprising a motor coupled to the cam and operable to rotate the cam to maintain the azimuthal orientation of the solid cam shaft while the solid cam shaft rotates within the cam.

10. The RSS of claim 6, wherein the solid cam shaft comprises titanium.

11. A method for drilling a wellbore into a formation comprising:

deploying a drill string comprising a rotary steerable system into the wellbore;

rotating a drill bit by rotating the rotary steerable system ("RSS") to rotate a hollow constant velocity ("CV") shaft to which the drill bit is coupled, which also rotates a solid cam shaft of the RSS positioned at a fixed offset;

adjusting an angular direction of the drill bit by rotating a cam of the RSS to rotate the solid cam shaft and adjust an azimuthal orientation of the solid cam shaft, which adjusts an azimuthal orientation of the hollow CV shaft and the drill bit;

pivoting rotation of the solid cam shaft to rotation of the CV shaft using a shaft cap coupling the solid cam shaft to the CV shaft;

flowing drilling fluid through the RSS in an area outside the solid cam shaft, through a channel of the shaft cap and into a bore of the shaft cap, through the hollow CV shaft, and to the drill bit;

rotating the cam to maintain the azimuthal orientation of the solid cam shaft and thus the drill bit; and drilling the borehole with the drill bit in the azimuthal orientation.

12. The method of claim 11, further comprising replacing the cam and solid cam shaft with a different cam and solid cam shaft at a different fixed offset.

13. The method of claim 11, further comprising maintaining the azimuthal orientation of the solid cam shaft with a motor while the solid cam shaft rotates about a solid cam shaft central axis.

* * * * *